United States Patent [19]

Belokin

[11] Patent Number: 4,570,837

[45] Date of Patent: Feb. 18, 1986

[54] ADHESIVE TAPE DISPENSING HOLDER

[75] Inventor: Martin P. Belokin, Denton, Tex.

[73] Assignee: Martin Paul, Inc., Denton, Tex.

[21] Appl. No.: 645,791

[22] Filed: Aug. 30, 1984

[51] Int. Cl.[4] ..... B26F 3/02

[52] U.S. Cl. ..... 225/42; 225/45; 225/77

[58] Field of Search ..... 225/42, 44, 45, 77, 225/90; 220/345, 346

[56] References Cited

U.S. PATENT DOCUMENTS

| | | | |
|---|---|---|---|
| 2,276,296 | 3/1942 | Flood | 225/44 |
| 2,476,593 | 7/1949 | Gerbing | 225/44 |
| 3,193,433 | 7/1965 | Tillotson | 225/44 |
| 3,373,865 | 3/1968 | Hollins | 225/44 |
| 4,088,276 | 5/1978 | Littleton | 225/78 |
| 4,130,229 | 12/1978 | Pagnini | 225/42 |
| 4,342,403 | 8/1982 | Badtke et al. | 220/345 |

*Primary Examiner*—Frank T. Yost
*Assistant Examiner*—Hien H. Phan
*Attorney, Agent, or Firm*—James E. Nilles

[57] ABSTRACT

A dispensing holder for adhesive tape comprises a body molded in one piece and an extruded closure member of elastomeric material impregnated with magnetic material. The closure member has a flat outer surface for magnetic adherence to an upright wall of a metal desk or filing cabinet and has ledges at its rear, extending along its top and bottom edges, that define grooves which open toward one another. The body has a flat wall at one side, is open at its other side, has top and bottom walls projecting from its side wall to its open side, and has a cylindrical protuberance projecting from its side wall to its open side on which a tape roll is rotatably receivable. At the open side of the body its top and bottom walls have edgewise oppositely projecting flanges that are received in the grooves in the closure member to slidably connect the body and closure member. An abutment on a rear wall of the body defines a forward limit of sliding of the body relative to the closure member at which the closure member supports the body and cooperates with the body side wall to confine the tape roll axially.

3 Claims, 3 Drawing Figures

ADHESIVE TAPE DISPENSING HOLDER

FIELD OF THE INVENTION

This invention relates to dispensing holders for adhesive tape and is more particularly concerned with an adhesive tape dispensing holder that is detachably securable to a substantially flat and upright supporting surface such as a side of a desk or filing cabinet.

BACKGROUND OF THE INVENTION

Numerous dispensing holders have been devised for self-adhering adhesive tape such as the well-known Scotch brand of tape, but most such holders are intended to rest on a desk top, diminishing the working space available there. Nevertheless, an adhesive tape dispenser is so nearly indispensable that it should always be readily accessible.

Basically, an adhesive tape dispenser comprises a rotatable support for a roll of tape and a cutter by which a length of tape that has been drawn off of the roll can be severed by jerking it downwards.

Because of the stickiness of the tape, considerable tension has to be exerted on it to unwind it from the roll. Prior light and inexpensive dispensing holders therefore required the use of two hands, one to hold the holder and the other to draw out and cut the tape. To facilitate single-handed dispensing, a holder must not only confine the tape to rotation but must itself offer strong resistance to forces that tend to move it. Prior single-handed dispensing holders have therefore been made relatively heavy or have been provided with bottom suction cups. In either case such holders have had to be relatively large and expensive.

Loading tape into most prior tape dispensers has not presented any noteworthy inconvenience, but they have nevertheless left room for improvement in this respect, although it has not been obvious how such improvement might be attained.

Thus the art has not heretofore achieved a dispensing holder for adhesive tape that offers the utmost in convenience combined with extreme low cost, compactness and lightness.

SUMMARY OF THE INVENTION

One general object of the present invention is to reduce desk-top clutter by providing a dispensing holder for adhesive tape that is detachably securable to an upright substantially flat surface, such as the side of a desk or a filing cabinet, where the holder will be out of the way but nevertheless very readily accessible, and where it can always be quickly found without having to identify it from among the many articles that tend to accumulate on a horizontal working surface and always seem to be changing positions there.

Another general object of this invention is to provide a dispensing holder of the character just described that provides for single-handed unrolling and cutting of adhesive tape but is nevertheless very light, compact and inexpensive.

A further and more specific object of the invention is to provide a dispensing holder of the above described character that can be inexpensively produced in the form of two slidably connected pieces, one of them a unitary body member that can be molded of plastic, the other a closure member that can be formed by extrusion.

It is also a specific object of this invention to provide a dispensing holder of the character described that can be loaded and unloaded with the utmost speed and convenience.

It is also a specific object of this invention to provide a two-piece dispensing holder of the above described character wherein the body member comprises an integral tape cutter.

An additional object of the invention, achieved concomitantly with the attainment of the above-stated objects, is to provide a dispensing holder for adhesive tape which is attractive in appearance as well as being very low in cost and affording unusual convenience.

In general, these and other objects of the invention that will appear as the description proceeds are achieved in the dispensing holder of this invention, which is adapted for detachable securement to an upright, substantially flat supporting surface and which comprises a one-piece body member and a one-piece closure member. The body member, which has front and rear ends and opposite sides, is characterized by having a substantially flat upright side wall at one side thereof and being open at its other side. The body member is further characterized by a substantially cylindrical protuberance intermediate its front and rear ends, projecting axially from its said side wall towards its said other side, for rotatably supporting a roll of adhesive tape. The body also has top and bottom walls, respectively spaced above and below said protuberance, each projecting sidewardly from said side wall to have a free edge at said other side of the body. Along the free edge of each of the top and bottom walls there is an edgewise vertically projecting flange, both of said flanges being substantially contained in a plane that is parallel to said side wall, and each said flange being elongated from front to rear of the body and being lengthwise parallel to the other. The closure member has an outer surface which is adherently securable to a flat, upright supporting surface, an inner surface which is substantially flat, and elongated ledges that extend lengthwise along a pair of opposite edges of it, said ledges being lengthwise parallel to one another and overlying said inner surface in inwardly spaced relation thereto, and being opposingly engageable with said flanges for connecting the closure member to the body in forwardly and rearwardly slideable relation thereto. The body has abutment means thereon, near the rear end thereof, providing a forwardly facing surface engageable with a rear edge portion of the closure member to define a rearward limit of sliding of the closure member relative to the body at which the closure member extends across said protuberance to substantially confine a roll of tape thereon to rotation.

Preferably the closure member is substantially rectangular, with straight and parallel top and bottom edges along which said ledges extend and straight and parallel front and rear edges, and it has a vertical cross-section that is uniform along its length from its front edge to its rear edge. It can thus be formed as an extrusion, preferably of an elastomeric material impregnated with magnetized material.

BRIEF DESCRIPTION OF DRAWINGS

In the accompanying drawings, which illustrate what is now regarded as a preferred embodiment of the invention.

DETAILED DESCRIPTION OF PREFERRED EMBODIMENT OF THE INVENTION

Figure 1:
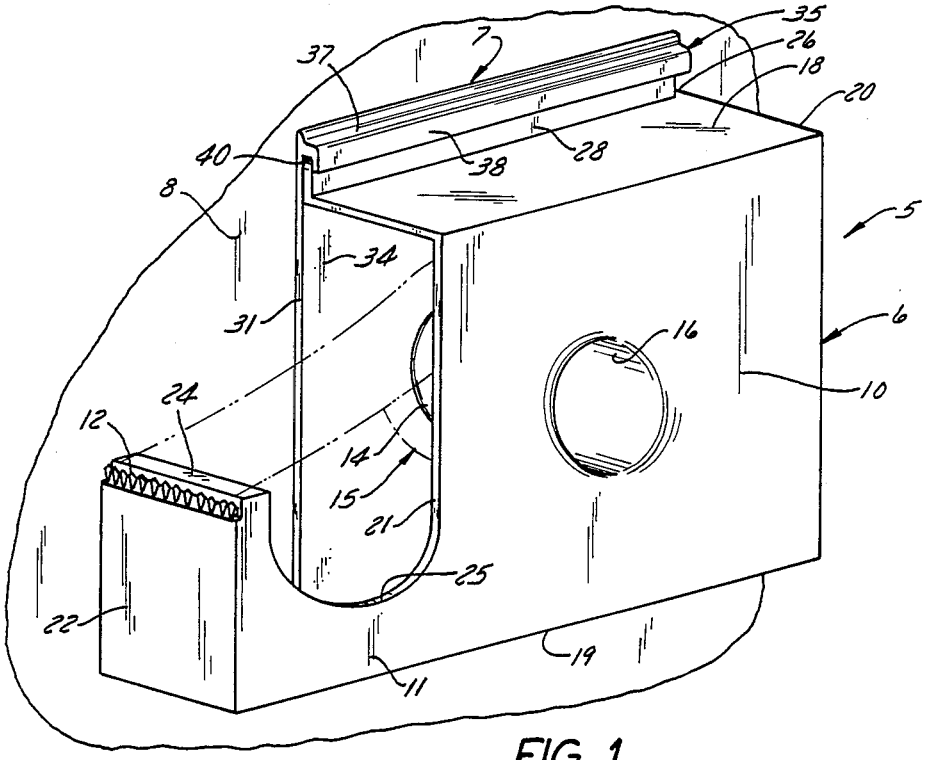
FIG. 1 is a side perspective view of a dispensing holder for adhesive tape that embodies the principles of this invention.
Figure 2:
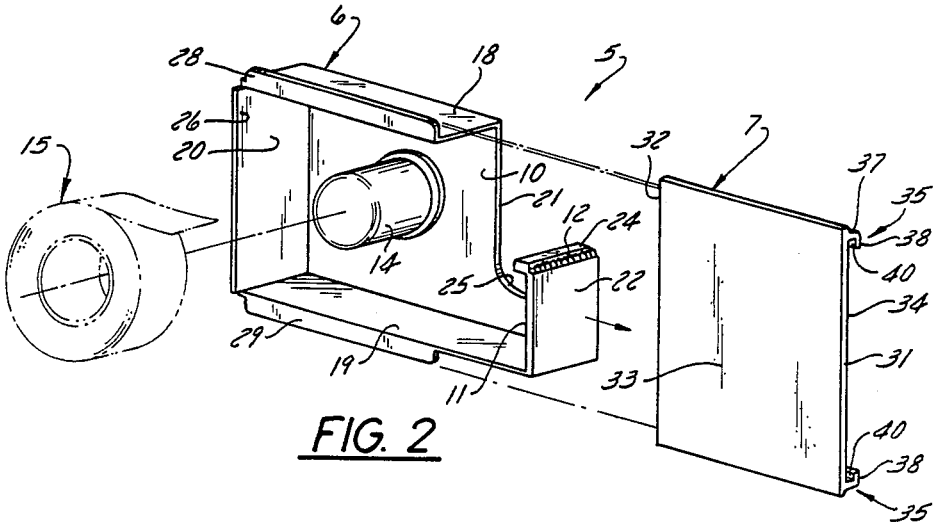
FIG. 2 is a disasembled perspective view of the holder, as seen from its side opposite that of FIG. 1.
Figure 3:
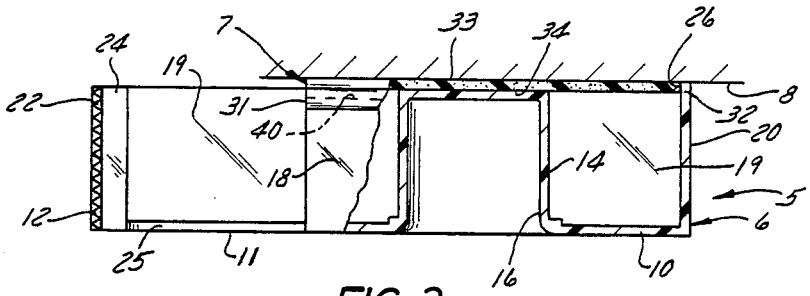
FIG. 3 is a view of the holder in section, taken on a horizontal plane just above the cutter and looking downward.

A dispensing holder 5 for adhesive tape that embodies the principles of this invention need comprise no more than two parts, one of them a one-piece body 6 that can be molded of plastic, the other a closure member 7 that can be formed by extrusion. As explained hereinafter, the two parts 6 and 7 are slideably connected, and the closure member 7 provides for adherent securement of the holder 5 to a substantially flat, upright surface 8 such as a side wall of a desk or filing cabinet.

At one side of the body 6 there is a substantially flat, upright side wall 10, while the other side of the body is open but is closed by the closure member 7 when the two parts are in assembled relationship. The main portion of the body side wall 10 is substantially rectangular in outline, but at its bottom that side wall has a forwardly projecting portion 11 that supports a tape cutter 12 described hereinafter.

A substantially cylindrical protuberance 14 projects axially from the body side wall 10 towards the open side of the body, the axis of the protuberance being near the center of the rectangular main portion of the side wall. As will be apparent, a roll 15 of adhesive tape can be slipped axially onto the cylindrical protuberance 14 through the open side of the body, and the closure member 7, when assembled to the body, substantially confines the roll 15 to rotation on the protuberance. For lightness and economy, the protuberance 14 can be cored out to define a coaxial well 16 that opens through the side wall 10.

Projecting from the body side wall 10 toward the open side of the body are a top wall 18 that is spaced above the protuberance 14, a bottom wall 19 that is spaced below the protuberance, and a rear wall 20 that is spaced to the rear of the protuberance. Each of these walls 18, 19, 20 is preferably straight and flat and has its surfaces substantially normal to the upright side wall 10. Since these walls 18, 19, 20 are integrally connected with one another and the side wall 10, the body can have great strength and rigidity even though all of its walls are made relatively thin in the interests of low cost.

The top wall 18 has its front end in line with the vertical front edge 21 of the rectangular main portion of the side wall 10. The bottom wall 19 is substantially longer than the top wall 18, extending all along the forwardly projecting portion 11 of the side wall 10 and cooperating therewith to support a short front wall 22, the top of which comprises the tape cutter 12. A short rearward projection 24 on the top of the top wall defines a flat upper surface which serves as a tape pad to which the free end of a roll of tape 15 in the holder can be adhesively secured. An upwardly opening V-groove separates the tape pad 24 from the cutter 12, which is in front of the tape pad and is formed to provide a sharp, serrated, upwardly projecting edge. The upper edge of the forwardly projecting portion 11 of the body side wall 10 defines a deep bay 25 which is preferably semicircular and which provides for ready access to the length of tape that normally extends from the roll 15 to the tape pad 24.

The top and bottom walls 18 and 19 and the short front wall 22 are all of the same width and thus have free edges at the open side of the body which are all contained in a plane that is parallel to the flat side wall 10 of the body. However, the rear wall 20 is somewhat wider than the other walls 18, 19, 22, and thus its free edge, at the open side of the body, is at the side of said plane that is remote from the side wall 10; that is, a marginal portion 26 of the rear wall 20 projects beyond the plane that contains the free edges of the other sidewardly extending walls 18, 19, 22.

Along the free edge of the top wall 18 there extends an elongated edgewise upwardly projecting flange 28, and along the free edge of the bottom wall 19 there extends a similar but edgewise downwardly projecting flange 29. These flanges 28, 29, which are coplanar and lengthwise parallel to one another, provide for securement of the closure member 7 to the body 6. Attention is directed to the fact that the body 6, at its open side, has no reentrant or inwardly projecting portions that might complicate molding it or ejection of the molded body from a relatively simple die.

The closure member 7 is rectangular, having a length between its straight, upright end edges 31, 32 that is substantially equal to the length of the rectangular main part of the body side wall 10. It has an outer surface 33 that is adherently securable to an upright wall or supporting surface 8 and a flat inner surface 34. In the preferred case here shown, the closure member 7 is formed of an elastomeric material impregnated with magnetized material, and its outer surface 33 is flat so that it can magnetically adhere to a magnetically permeable supporting surface 8 such as an upright surface of a metal desk or filing cabinet. It will be recognized that other means could be provided for causing the closure member to adhere to an upright surface, but the magnetic expedient is considered preferable from the standpoint of low cost, convenience, security of attachment, and capability for quick detachment without leaving a trace on the supporting surface.

Along each of its straight and parallel top and bottom edges the closure member has an elongated ledge 35 which cooperates with one of the flanges 28, 29 on the body 6. Each ledge 35 is substantially L-shaped in cross-section, with one leg 37 that projects laterally inwardly and one edgewise vertically projecting leg 38 that overlies the flat inner surface 34 of the closure member in inwardly spaced relation to that surface. It will be apparent that each of the ledges 35 on the closure member 7 defines a groove 40 which opens towards the similar groove defined by the other ledge and in which one of the flanges 28, 29 on the body is lengthwise slideably receivable. The ledges 35 thus engage around the flanges 28 and 29 to connect the closure member 7 with the body 6 and confine the closure member and the body to relative forward and rearward sliding motion.

The projecting marginal portion 26 of the rear wall 20 of the body provides a forwardly facing abutment against which the rear edge 32 of the closure member is engageable to define a forward limit of sliding of the body relative to the closure member. Hence, when the closure member 7 is adherently secured to an upright surface 8, the body can be detached from it by merely sliding the body rearwardly, and the body is merely slid forward for reassambly with the closure member. Thus a tape roll 15 in the holder can be readily replaced without detaching the closure member 7 from the surface 8 that supports it. The forward force exerted on the body 6 as tape is drawn out of it is of course resisted by the closure member owing to the engagement of the abutment 26 on the body against the rear edge 32 of the closure member.

It will be observed that the closure member 7 has a vertical cross-section which is uniform all along its length, so that it is capable of inexpensive production as a long extruded strip cut to appropriate lengths. Furthermore, assembly of the closure member with the body is simplified by the fact that the closure member, in cross-section, can be symmetrical to a horizontally extending centerline.

From the foregoing description taken with the accompanying drawings it will be apparent that this invention provides a very inexpensive, compact and lightweight dispensing holder for adhesive tape, capable of being mounted instantly and securely on an upright surface where it is out of the way but nevertheless conveniently accessible. It will also be apparent that tape can be drawn and cut with one hand from the dispensing holder of this invention, notwithstanding its light weight, and that reloading the holder with tape can be accomplished very quickly and easily, without the need for detaching its closure member from a supporting surface to which it is adherently attached.

What is claimed as the invention is:

1. A dispensing holder for a roll of adhesive tape, adapted for detachable securement to an upright substantially flat supporting surface, characterized by:

A. a one-piece body that has front and rear ends and opposite sides, said body having a substantially flat upright side wall at one side thereof and being open at its other side, and further having
  (1) a substantially cylindrical protuberance intermediate its front and rear ends projecting axially from said side wall towards said other side of the body, for rotatably supporting a roll of adhesive tape,
  (2) top and bottom walls, respectively spaced above and below said protuberance, each projecting sidewardly from said side wall to have a free edge at said other side of the body, said bottom wall projecting forwardly a substantial distance beyond the front end of said top wall,
  (3) an upward projecting on the front end of said bottom wall that defines an upwardly projecting tape cutting edge which is spaced a substantial distance below the level of the front end of the top wall,
  (4) an edgewise vertically projecting flange along said free edge of each of said top and bottom walls, both of said flanges being substantially contained in a plane that is parallel to said side wall, and each said flange
    (a) being elongated from front to rear of the body and
    (b) being lengthwise parallel to the other and projecting edgewise oppositely to said other, and
  (5) a rear wall spaced to the rear of said protuberance, said rear wall being connected with the respective rear ends of said top and bottom walls and projecting from said side wall sidwardly beyond said plane to have a marginal portion adjacent to said plane which defines a forwardly facing abutment surface; and B. a substantially rectangular one-piece closure member having opposite front and rear edges and having opposite straight and parallel top and bottom edges, said closure member further having
  (1) an outer flat surface which is adherently securable to a flat upright supporting surface,
  (2) an opposite inner surface which is substantially flat,
  (3) a vertical cross-section that is uniform along its length from its front edge to its rear edge, and
  (4) elongated ledges that extend lengthwise along said top and bottom edges, said ledges
    (a) being lengthwise parallel to one another and
    (b) overlying said inner surface in inwardly spaced relation thereto, said ledges being opposingly engageable over said flanges for connecting the closure member to said body in forwardly and rearwardly slidable relation thereto, the rear edge of said closure member being engageable with said abutment surface to define a rearward limit of sliding of the closure member relative to the body at which the closure member extends across said protuberance to confine a roll of tape thereon and from which the body cannot move forward relative to the closure member as tape is drawn forwardly from said roll toward said cutting edge.

2. The dispensing holder of claim 1, further characterized by: said closure member being of an elastomeric material impregnated with magnetized material, and said outer surface thereof being substantially flat for magnetic flatwise adherence to a magnetically permeable supporting surface.

3. A dispensing holder for a roll of adhesive tape, adapted for detachable securement to an upright substantially flat supporting surface, characterized by:

A. a one-piece supporting and closure member of elastomeric material impregnated with magnetic material, said supporting and closure member having
  (1) opposite front and rear edges and opposite straight and parallel top and bottom edges,
  (2) a vertical cross-section that is uniform along its length from its front edge to its rear edge,
  (3) opposite substantially flat inner and outer surfaces, said outer surface being flatwise engageable with a substantially upright supporting surface to which the supporting and closure member is magnetically attached, and
  (4) opposite horizontally elongated, lengthwise parallel upper and lower edges which project inwardly beyond said inner surface and extend, respectively, along said upper and lower edges, each said ledge defining a groove which opens towards the groove defined by the other; and B. a one-piece body having front and rear ends and having a substantially flat upright side wall at one side thereof, said body being open at its opposite side and further having
  (1) top and bottom walls projecting sidewardly from said side wall to said opposite side, said bottom wall projecting forwardly a substantial distance beyond the front end of said top wall,
  (2) an upward projection on the front end of said bottom wall that defines an upwardly projecting tape cutting edge which is spaced a substantial distance below the level of the front end of the top wall, (3) an edgewise vertically projecting flange on each of said top and bottom walls, at said opposite side of the body, said flanges being coplanar, elongated in the direction from front to rear of the body, and projecting edgewise away from one another for reception in said grooves to connect the body and the supporting and closure member for relative sliding rearwardly and forwardly, to and from a relationship in which the supporting and closure member substantially closes said opposite side of the body, (4) a substantially cylindrical protuberance projecting from said side wall towards said opposite side of the body, spaced from said top and bottom walls, onto which a roll of tape can be installed through said open side of the body and on which the roll is confined to rotation by said supporting and closure member when it has said relationship to the body, and (5) a rear wall projecting sidewardly from said side wall across and beyond the plane of said flanges to define a forwardly facing abutment against which the rear edge of the supporting and closure member engages to establish said relationship and whereby the body is maintained in said relationship to the supporting and closure member as tape is drawn forwardly off of the roll and across said cutting edge.

* * * * *